US011142994B2

(12) United States Patent
Yuan et al.

(10) Patent No.: US 11,142,994 B2
(45) Date of Patent: Oct. 12, 2021

(54) BUOYANCY ASSIST TOOL WITH ANNULAR CAVITY AND PISTON

(71) Applicant: Halliburton Energy Services, Inc., Houston, TX (US)

(72) Inventors: Min Mark Yuan, Katy, TX (US); Lonnie Carl Helms, Humble, TX (US); Mayur Narain Ahuja, Friendswood, TX (US); Ishwar Dilip Patil, Spring, TX (US); Frank Vinicio Acosta, Spring, TX (US); Clayton Reed Bonn, Alvin, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/794,322

(22) Filed: Feb. 19, 2020

(65) Prior Publication Data

US 2021/0254430 A1 Aug. 19, 2021

(51) Int. Cl.
*E21B 34/06* (2006.01)
*E21B 33/134* (2006.01)

(52) U.S. Cl.
CPC ..... *E21B 34/063* (2013.01); *E21B 33/134* (2013.01)

(58) Field of Classification Search
CPC ..... E21B 33/134; E21B 34/063
USPC ..... 166/317
See application file for complete search history.

(56) References Cited

U.S. PATENT DOCUMENTS 3,463,351 A 8/1969 Mills
3,779,263 A 12/1973 Edwards et al.
3,980,134 A 9/1976 Amancharla
4,457,376 A 7/1984 Carmody et al.
5,150,756 A 9/1992 Hassanzadeh
5,479,986 A 1/1996 Gano et al.
5,765,641 A 6/1998 Shy et al.
5,826,661 A 10/1998 Parker et al.
6,026,903 A 2/2000 Shy et al.
6,076,600 A 6/2000 Vick, Jr. et al.
6,161,622 A 12/2000 Robb et al.
6,324,904 B1 12/2001 Ishikawa et al.
6,450,263 B1 9/2002 Schwendemann
6,505,685 B1 1/2003 Sullaway et al.
(Continued)

FOREIGN PATENT DOCUMENTS

EP 0566290 A1 10/1993
EP 061087 B1 9/2000
(Continued)

OTHER PUBLICATIONS

International Search Report and Written Opinion dated Jul. 21, 2020, issued in PCT Application No. PCT/US2019/059864.
(Continued)

*Primary Examiner* — Matthew R Buck
*Assistant Examiner* — Patrick F Lambe
(74) *Attorney, Agent, or Firm* — McAfee & Taft

(57) ABSTRACT

A downhole apparatus comprises a casing string with a removable plug therein to block flow therethrough. A flow barrier is positioned in the casing below the removable plug and the removable plug and the flow barrier defining a buoyancy chamber therebetween. A debris barrier positioned above the removable plug comprises a rigid annular ring with a flexible diaphragm covering the center opening defined by the annular ring.

20 Claims, 4 Drawing Sheets

(56) References Cited

U.S. PATENT DOCUMENTS

| | | | | |
|---|---|---|---|---|
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1* | 6/2014 | Fripp | E21B 29/02 166/376 |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1* | 1/2018 | Norman | E21B 34/14 |
| 2018/0058179 | A1 | 3/2018 | Nuryaningsih et al. | |
| 2018/0080308 | A1* | 3/2018 | Dedman | E21B 43/10 |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/0031541.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jan. 16, 2020, issued in PCT Application No. PCT/US2019/027625.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.

* cited by examiner

BUOYANCY ASSIST TOOL WITH ANNULAR CAVITY AND PISTON

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
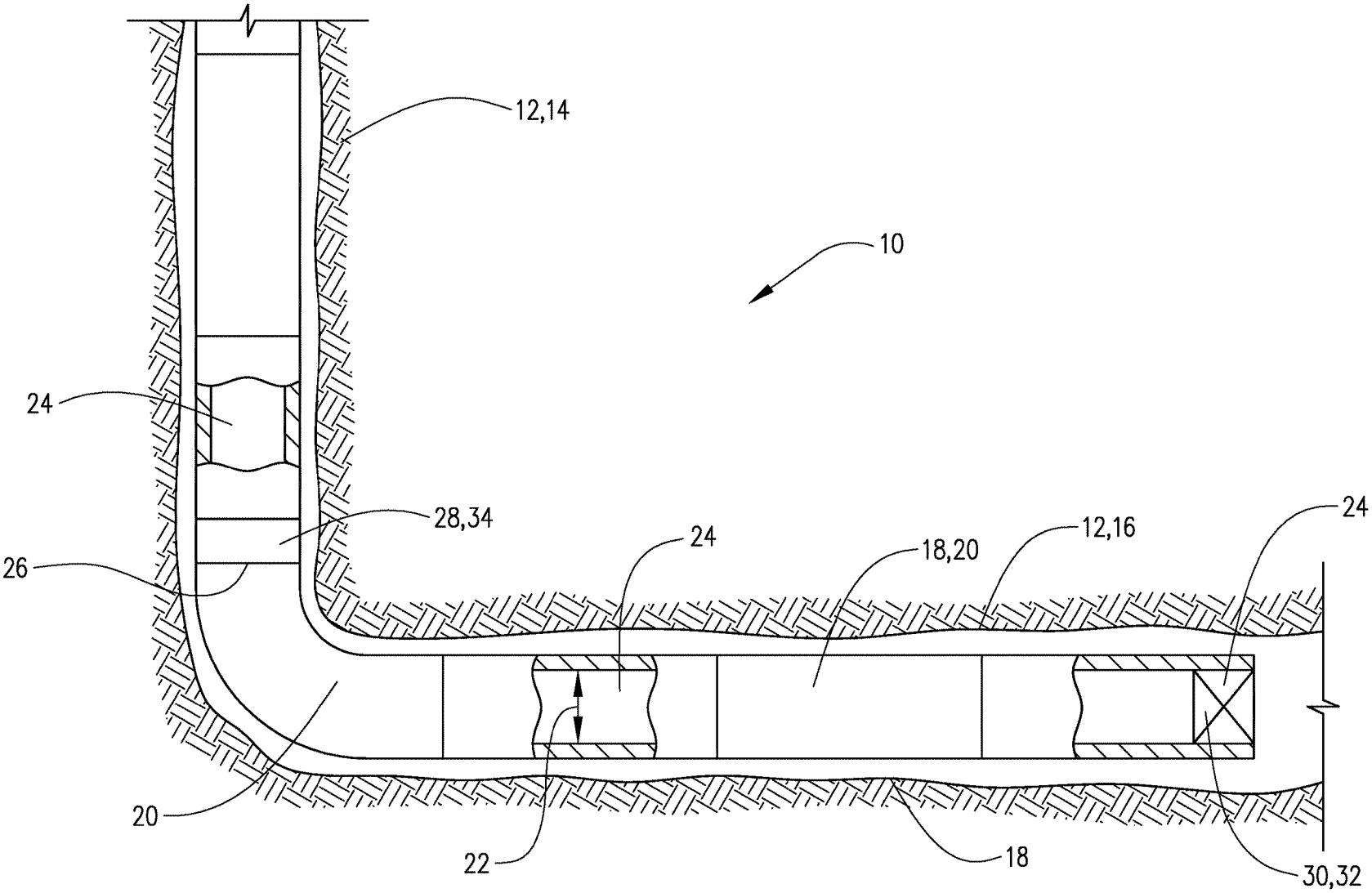
FIG. 1 is a schematic view of an exemplary well bore with a well casing including a buoyancy chamber therein.
Figure 2:
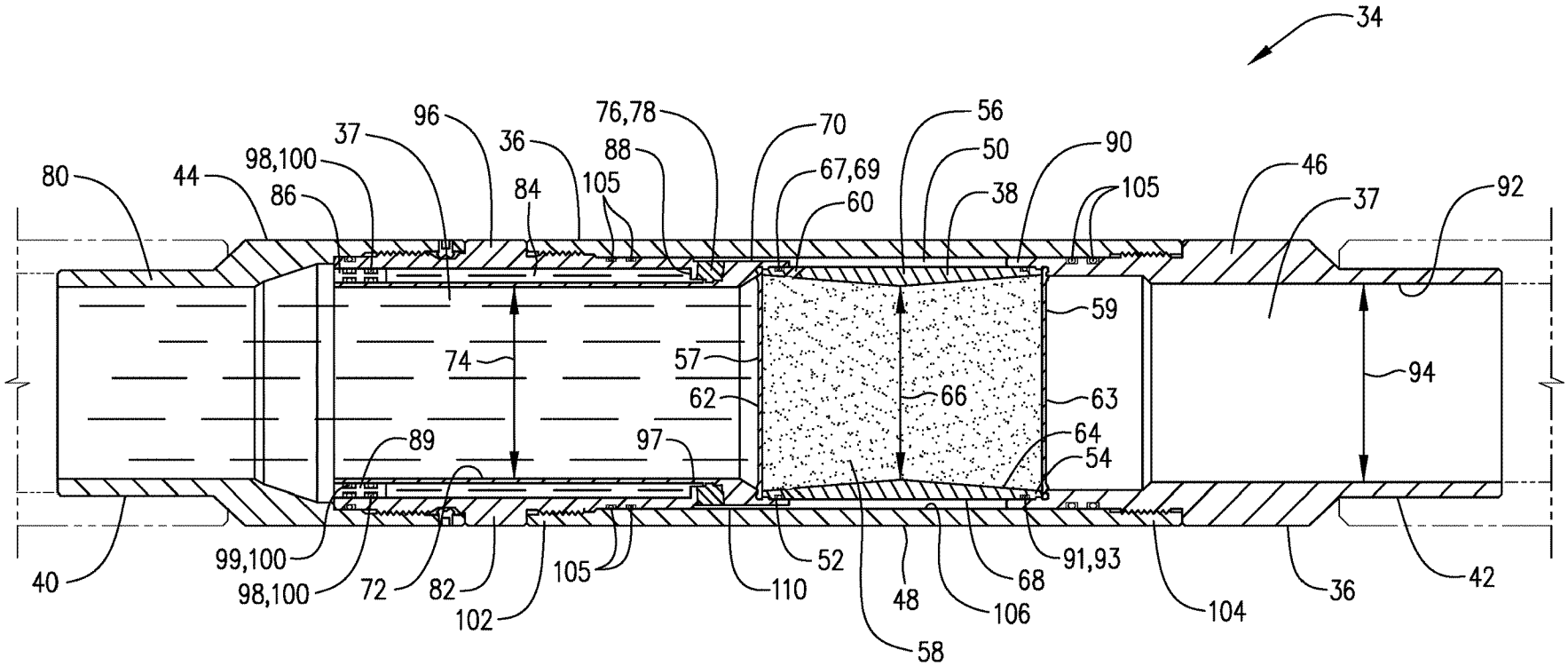
FIG. 2 is a cross section of a buoyancy assist tool of the current disclosure.
Figure 3:
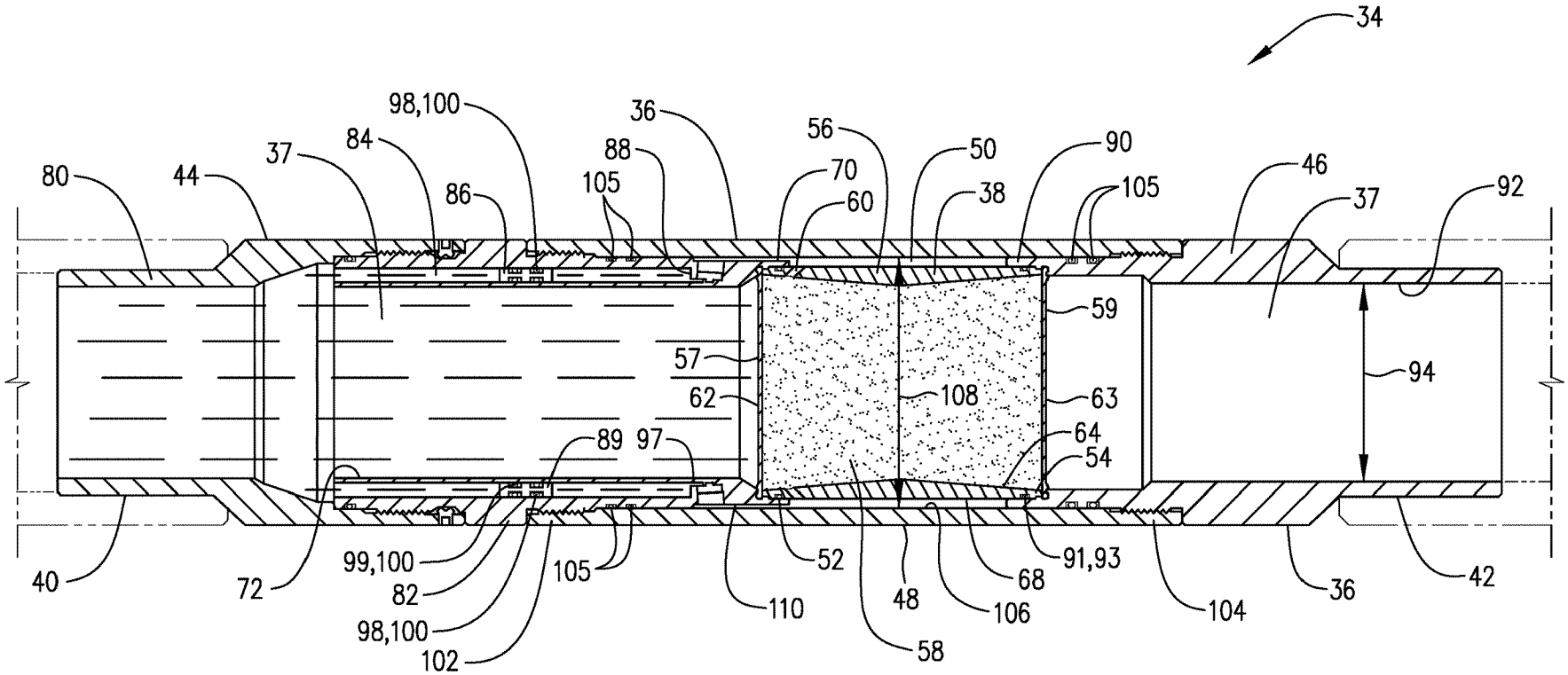
FIG. 3 is a cross section of a buoyancy assist tool of FIG. 2 after pressure has been applied to the annular piston
Figure 4:
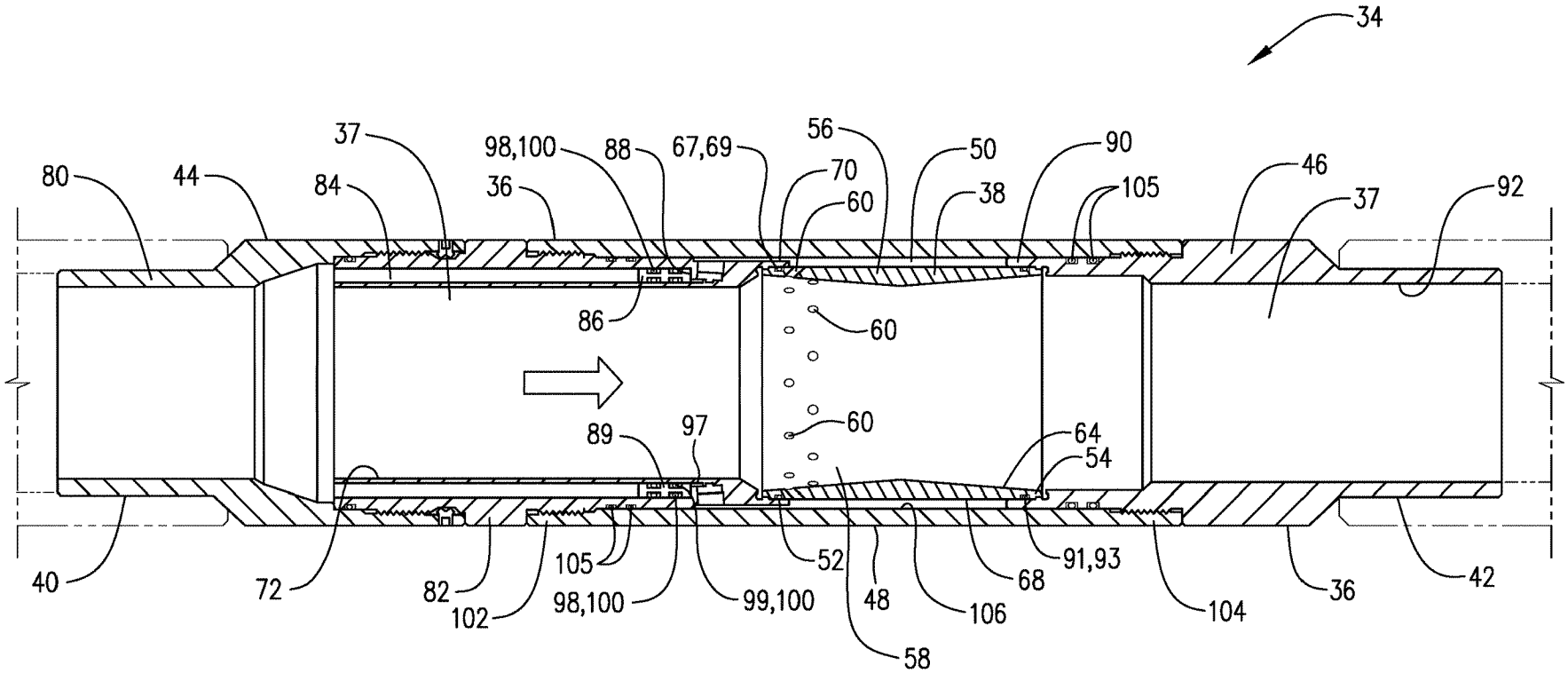
FIG. 4 is a cross section of the buoyancy assist tool of FIG. 2 after the plug has degraded and removed from the buoyancy assist tool.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these are used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally a one-way check valve. The float device 30 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the wellbore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Membranes 62 and 63 will prevent fluid thereabove from contacting the degradable plug at the upper end of the plug assembly 38 prior to the time casing string 18 is placed at the desired location in wellbore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Plug assembly 38 is connected at its upper end 52 to the lower end 70 of upper outer case 44. Outer surface 68 of plug housing 56 may have a groove 67 with an O-ring seal 69 therein to sealingly engage an inner surface of upper outer case 44. Upper outer case 44 has inner surface 72 which defines an inner diameter 74 that is a minimum inner diameter of upper outer case 44. In the embodiment shown upper outer case 44 has a port 76 therethrough. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disk or other rupturable membrane 78 is positioned in port 76 in upper outer case 44. Rupture disk 78 will prevent flow through port 76 until a desired or pre-determined pressure is reached in casing string 18. Upon reaching the pre-determined pressure the rupture disk 78 will rupture and fluid will be communicated from casing string 18 through port 76 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

The degrading fluid is contained in annular fluid filled cavity 84 defined in the wall of outer case 36. Annular fluid filled cavity 84 has upper end 86 and lower end 88. A piston 89, which may be for example an annular piston, is slidably and sealingly received in annular cavity 84 and defines the upper end 86 thereof. Upper membrane 62 prevents the fluid in outer case 36 from contacting degradable plug 58 prior to the rupturing of rupture disk 78. Upper outer case 44 may be a two piece outer case comprising an upper portion 80 that is threadedly and sealingly connected to lower portion 82. Lower portion 82 connects to plug assembly 38 as shown in the figures. Upper outer case 44 may define annular cavity 84 which is a closed fluid filled cavity 84. Fluid in annular fluid filled cavity 84 is trapped between piston 89 and rupture disk 78. There are certain formations in which it is not desirable to pump water. In those instances oil or another fluid other than water, such as a mud based fluid, may be utilized to fracture or otherwise treat the formation. Where, for example, water is the degrading fluid, but not the treatment fluid, water will be contained in the annular fluid filled cavity 84 such that upon reaching the appropriate position in the well oil, mud or other fluid may be pumped through the casing string 18 so that as described in more detail below piston 89 will be urged downwardly until a predetermined pressure is applied to rupture disk 78 to burst the rupture disk 78 so that water or other degrading liquid from annular fluid filled cavity 84 will contact the degradable plug 58. The degrading liquid in annular fluid filled cavity 84 passes into annular space 50 and from annular space 50 through ports 60 in housing plug 56 and will contact the degradable plug 58 until it is degraded or dissolved sufficiently such that the fluid pressure above the degradable plug 58 will remove the degradable plug 58 from outer case 36.

Annular fluid filled cavity 84 is defined in a wall 96 of outer case 36, and more specifically lower portion 82 of upper outer case 44. A connecting passage 97 connects annular fluid filled cavity 89 with port 76 so that fluid pressure may be applied to rupture disk 78. Piston 89 is an annular or ring-shaped piston with grooves 98 on an outer surface thereof and grooves 99 on an inner surface thereof. Seals 100 are placed in grooves 98 and 99 so that piston 89 sealingly engages annular cavity 89.

Lower outer case 46 has upper end 90 and a lower end which is the lower end 42 of buoyancy assist tool 34. Upper end 90 of lower outer case 46 is connected to lower end 54 of plug assembly 38. Outer surface 68 of plug housing 56 may have a groove 91 with an O-ring seal 93 therein to sealingly engage lower outer case 46. Lower outer case 46 has inner surface 92 defining an inner diameter 94. Inner diameter 94 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 102 and lower end 104. Connecting sleeve 48 is connected at its upper end 102 to an outer surface of upper outer case 44 and is connected at its lower end 104 to an outer surface of lower outer case 46. O-ring seals 105 may be positioned in grooves in the outer surfaces of the upper and lower outer cases 44 and 46 respectively to sealingly engage an inner surface 106 of connecting shield 48. Inner surface 106 of connecting shield 48 defines an inner diameter 108. An annular passageway 110 is defined by and between upper outer case 44 and connecting shield 48. Annular passageway 110 communicates fluid delivered through port 76 into annular space 50. Fluid is communicated through ports 60 so that it will contact degradable plug 58 to dissolve or degrade the plug.

In operation casing string 18 is lowered into wellbore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the casing string 18 has reached the desired position in the wellbore, pressure is increased and fluid pumped through the casing string 18. The pressure will cause piston 89 to move downwardly in annular fluid filled cavity 84 until at a predetermined pressure rupture disk 78 bursts. Once rupture disk 78 bursts, degrading fluid from annular fluid filled cavity 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56.

Typically, once the degradation process reaches a certain level, the degradable plug 58 will break up, and at that point both of upper and lower membranes 62 and 63 will likewise be broken, and the pieces thereof along with pieces of the degradable plug will pass through casing string 18. As a result buoyancy assist tool 34 will have an open passageway, and will not present a restriction to the passage of any tool that will otherwise pass through the casing string 18.

A downhole apparatus comprises an outer case defining an annular cavity in a wall thereof, the annular cavity having an upper end and having a lower end. A plug housing is connected in the outer case, and the plug housing and outer case define an annular space therebetween. A degradable plug is fixed in the plug housing. A piston is slidably and sealingly disposed in the annular cavity. The annular cavity contains a fluid and a rupture disk is disposed in a port in the wall of the outer case. The annular cavity is communicated with the port.

The downhole apparatus may further comprise a casing, the outer case being connected in the casing at upper and lower ends thereof to the casing. The degradable plug and a flow barrier connected in the casing below the degradable plug define a buoyancy chamber therebetween. A fluid in the casing is in contact with the piston. The annular cavity is communicated with the annular space between the outer case and the plug housing through the port after the rupture disk ruptures. The plug housing has a plurality of openings therethrough and fluid from the annular cavity is communicated from the annular space between the outer case and the plug housing to the degradable plug through the openings. A connecting channel in the outer case communicates the annular cavity with the port.

An additional embodiment of a downhole apparatus may comprise a casing string and an outer case connected in the casing string. The outer case defines an annular cavity in a wall thereof. A rupture disk is positioned in a port in the outer case. The annular cavity is fluidicly connected to the port. A plug housing is connected in the outer case and the plug housing and outer case define an annular passage therebetween. The port is in communication with the annular passage. A degradable plug is fixed in the plug housing. A piston is sealingly received in the annular cavity. The piston is configured to move downwardly in the annular cavity upon the application of fluid pressure in the casing thereabove. The rupture disk is configured to burst at a predetermined pressure as the piston is moved downwardly in the annular cavity. The plug housing defines a plurality of openings in a wall thereof. The openings in the plug housing are communicated with the annular passage so that fluid from the annular cavity is communicated through the openings to contact the degradable plug. The piston may be positioned at an upper end of the fluid in the annular cavity. The downhole apparatus may also comprise a flow barrier connected in the casing below the degradable plug. The flow barrier and degradable plug define a buoyancy chamber therebetween. The outer case defines a connecting channel configured to communicate fluid from the annular cavity to the port.

An additional embodiment of a downhole apparatus may comprise a casing. A flow barrier connected in the casing and buoyancy assist tool connected in the casing above the flow barrier define a buoyancy chamber therebetween. The buoyancy assist tool may comprise an outer case connected at upper end and lower ends in the casing. A degradable plug is positioned in the outer case to block flow therethrough. An annular fluid filled cavity is defined in a wall of the outer case and configured to communicate fluid to the degradable plug upon the application of a predetermined pressure thereto. A piston is sealingly received in the annular fluid filled cavity and movable therein upon the application of fluid pressure in the casing. A port in a wall of the outer case has a rupture disk therein and the annular fluid filled cavity is communicated with the port. A plug housing connected in the outer case has a degradable plug fixed therein. The plug housing and outer case define an annular space therebetween. The port in the wall of the outer case is communicated with the annular space between the outer case and the plug housing. The rupture disk is configured to burst as a result of the piston moving downwardly in the annular fluid filled cavity. An impermeable membrane covers an upper end of the degradable plug. The buoyancy assist tool defines an inner diameter that is no more restrictive for the passage of downhole tools than the inner diameter of the casing in which the buoyancy assist tool is connected.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

an outer case defining an annular cavity in a wall thereof, the annular cavity having an upper end and having a lower end;

a plug housing connected in the outer case, the plug housing and outer case defining an annular space therebetween;

a degradable plug fixed in the plug housing;

a piston slidably and sealingly disposed in the annular cavity, the annular cavity containing a degrading fluid; and a rupture disk disposed in a port in the wall of the outer case, the annular cavity being communicated with the port, the rupture disk being rupturable upon downward movement of the piston in the annular cavity.

2. The downhole apparatus of claim 1 further comprising:

a casing, the outer case being connected in the casing at upper and lower ends thereof; and a flow barrier connected in the casing below the degradable plug, the degradable plug and flow barrier defining a buoyancy chamber therebetween.

3. The downhole apparatus of claim 2, the casing having a fluid therein in contact with the piston.

4. The downhole apparatus of claim 1, the annular cavity being communicated with the annular space between the outer case and the plug housing through the port after the rupture disk ruptures.

5. The downhole apparatus of claim 1, the plug housing having a plurality of openings therethrough, fluid from the annular cavity being communicated from the annular space between the outer case and the plug housing to the degradable plug through the openings.

6. The downhole apparatus of claim 1 the outer case defining a connecting channel communicating the annular cavity with the port.

7. The downhole apparatus of claim 6, further comprising an impermeable membrane covering an upper end of the degradable plug.

8. A downhole apparatus comprising:

a casing string;

an outer case connected in the casing string, the outer case defining an annular cavity filled with a degrading fluid in a wall thereof;

a rupture disk positioned in a port in the outer case, the annular cavity fluidicly fluidically connected to the port;

a plug housing connected in the outer case, the plug housing and outer case defining an annular passage therebetween, the port being in communication with the annular passage;

a degradable plug fixed in the plug housing;

a piston sealingly received in the annular cavity, the piston configured to move downwardly in the annular cavity to burst the rupture disk upon the application of fluid pressure in the casing thereabove.

9. The downhole apparatus of claim 8, the rupture disk configured to burst at a predetermined pressure as the piston is moved downwardly in the annular cavity.

10. The downhole apparatus of claim 9, the plug housing defining a plurality of openings in a wall thereof, the openings being communicated with the annular passage so that fluid from the annular cavity is communicated through the openings to contact the degradable plug.

11. The downhole apparatus of claim 8, the piston being positioned at an upper end of the fluid in the annular cavity.

12. The downhole apparatus of claim 8, further comprising a flow barrier connected in the casing below the degradable plug, the flow barrier and degradable plug defining a buoyancy chamber therebetween.

13. The downhole apparatus of claim 12, the rupture disk configured to burst at a predetermined pressure.

14. The downhole tool of claim 13, the outer case defining a connecting channel configured to communicate fluid from the annular cavity to the port.

15. A downhole apparatus comprising:

a casing;

a flow barrier connected in the casing; and a buoyancy assist tool connected in the casing above the flow barrier, the buoyancy assist tool and flow barrier defining a buoyancy chamber therebetween, the buoyancy assist tool comprising:

an outer case connected at upper ends and lower ends in the casing;

a degradable plug positioned in the outer case to block flow therethrough;

an annular cavity filled with a degrading fluid defined in a wall of the outer case and configured to communicate fluid to the degradable plug upon the application of a predetermined pressure thereto; and a piston sealingly received in the annular fluid filled cavity and movable downward therein upon the application of fluid pressure in the casing, the downward movement of the piston urging the fluid from the annular cavity into the degradable plug.

16. The downhole apparatus of claim 15, further comprising a rupture disk in a port in a wall of the outer case, the annular fluid filled cavity communicated with the port.

17. The downhole apparatus of claim 16, further comprising a plug housing connected in the outer case, the degradable plug fixed in the plug housing, the plug housing and outer case defining an annular space therebetween, the port being communicated with the annular space between the outer case and the plug housing.

18. The downhole apparatus of claim 16, the rupture disk being configured to burst as a result of the piston moving downwardly in the annular fluid filled cavity.

19. The downhole apparatus of claim 16 further comprising an impermeable membrane covering an upper end of the degradable plug.

20. The downhole apparatus of claim 15, the buoyancy assist tool defining an inner diameter that is no more restrictive for the passage of downhole tools than the inner diameter of the casing in which the buoyancy assist tool is connected.

* * * * *